US005758507A

United States Patent [19]

Schuster et al.

[11] Patent Number: 5,758,507

[45] Date of Patent: Jun. 2, 1998

[54] HEAT PUMP DEFROST CONTROL

[76] Inventors: Don A. Schuster, 247 Painted Hills, Martinsville, Ind. 46151; Hong Mei Liang, 6967 Bluffridge Way, Indianapolis, Ind. 46278; Louis J. Sullivan, 5637 Pinto Ct., Indianapolis, Ind. 46208

[21] Appl. No.: 695,403

[22] Filed: Aug. 12, 1996

[51] Int. Cl.[6] ..... F25D 21/06

[52] U.S. Cl. ..... 62/81; 62/155; 62/156; 62/234; 62/278

[58] Field of Search ..... 62/151, 155, 156, 62/140, 160, 177, 180, 157, 158, 234, 277, 278, 81; 165/240, 241, 242

[56] References Cited

U.S. PATENT DOCUMENTS

| | | | |
|---|---|---|---|
| 2,962,870 | 12/1960 | Von Arb et al. | 62/140 |
| 2,968,167 | 1/1961 | Raney | 62/156 |
| 3,899,895 | 8/1975 | Blanton et al. . | |
| 4,190,199 | 2/1980 | Cawley et al. | 165/240 X |
| 4,774,813 | 10/1988 | Yokoyama . | |
| 4,805,689 | 2/1989 | Inada et al. . | |
| 4,852,360 | 8/1989 | Harshbarger, Jr. | 62/156 X |
| 4,884,413 | 12/1989 | Quandt et al. | 62/177 X |
| 5,052,191 | 10/1991 | Shapiro-Baruch . | |
| 5,095,711 | 3/1992 | Marris et al. . | |
| 5,332,028 | 7/1994 | Marris . | |

FOREIGN PATENT DOCUMENTS

| | | |
|---|---|---|
| 54-137843 | 10/1979 | Japan . |
| 55-20387 | 2/1980 | Japan . |
| 63-273751 | 11/1988 | Japan . |

*Primary Examiner*—Harry B. Tanner

[57] ABSTRACT

The present invention relates to a method for alleviating a short-term "cold blow" effect in a heat pump heating system. According to a method of the invention, reversing of a system valve in response to the sensing of a defrost condition is delayed by a predetermined time. The amount of this delay time depends upon the amount of time required for a supplementary heating unit to achieve an output sufficient to offset the cooling effect resulting from there being a cold indoor coil.

14 Claims, 4 Drawing Sheets

HEAT PUMP DEFROST CONTROL

BACKGROUND OF THE INVENTION

1. Field of the Invention

The present invention relates to heat pump heating systems in general, and particularly to an improved method for controlling a supplementary heater during the defrosting of an outdoor coil of a heat pump heating system.

2. Background of the Prior Art

A heat pump heating system includes an indoor coil and an outdoor coil. When the heating system is in a heating mode, the outside coil acts as an evaporator. If the temperature of the heat transfer medium inside the coil falls below the dew point of the medium, condensation will form on the outside coil. This condensate will freeze if the outside ambient air temperature is near or below freezing. Because the heat pump operating in the heating mode requires refrigerant to be at a lower temperature than the ambient air in order to transfer heat to the refrigerant through the outdoor coil, condensation, and eventually ice or frost will tend to form on the coil even at ambient temperatures above the freezing point. This ice or frost impairs the overall efficiency of the heat pump heating system.

Accordingly, in a conventional heat pump heating system, the outside coil is periodically defrosted, normally in response to a signal from a sensor which directly or indirectly senses ice or frost buildup. The most common method for defrosting the outside coil is to reverse the refrigerant flow so that the outdoor coil functions as a condenser with the hot gases that are discharged from the compressor being circulated directly to the outdoor coil to melt the ice formed thereon. The indoor coil, meanwhile, functions as an evaporator with the refrigerant removing heat from the air being blown across it.

Unfortunately, when the indoor coil acts as an evaporator to transfer heat to the outside coil, cold air flows through the system's supply air duct. This condition is known as "cold blow."

Efforts have been made in the past to alleviate this problem of "cold blow". For example, it is generally known in the art to provide a supplementary heating unit or units which are activated during the defrosting process in order to heat up the air that is blown across the indoor coil. In many cases, however, these units are not sufficient to overcome the cooling capacity of the system. In other cases, the supplementary heating unit is too large and results in a building temperature above a building's thermostat temperature.

U.S. Pat. No. 5,332,028, issued to a common assignee, describes a heat pump heating system having a variable-demand supplementary heating unit whose output varies depending on the building temperature. While the system described in the '028 patent resolves the problem of heating unit heat output capacity, it does not address certain inherent limitations of commercially available heating units.

There exists a need for a control method for controlling a supplementary heating unit of a heat pump heating unit which takes into account certain inherent limitations of commercially available heating units.

SUMMARY OF THE INVENTION

According to its major aspects and broadly stated, the present invention is a method for controlling a supplementary heating unit of a heat pump type heating system during a defrost routine.

A heat pump type heating system includes an indoor coil, and an outdoor coil. In a heating mode of operation, the indoor coil functions as a condenser to provide heat to the indoor air, while in a cooling or defrost mode of operation, the outdoor coil functions as a condenser and the indoor coil functions as an evaporator. Ice and frost tend to build up on the outdoor coil when the system is in a heating mode of operation. For improved heating system operation, this ice and snow is defrosted from time to time in part by reversing a system valve to change the mode of the system to a defrost mode.

When the system is in a defrost mode, the indoor coil of the heating system, functioning as an evaporator, becomes cool. As a result, air that blows across the indoor coil is cooled significantly giving rise to a condition known as "cold blow." To minimize this cold blow effect, it is common to operate a supplementary heating unit for heating the supply air during defrosting of the outdoor coil. Whatever the type of supplementary heating unit used, however, there is delay between the time the supplementary heating unit is activated and the time the unit generates a desired output. In prior art systems, this inherent delay results in a short-term cold blow effect despite the providing of supplementary heat.

The control method of the present invention is adapted to overcome this short-term cold blow effect. In the present invention, the supplementary heating unit is turned on in response to the sensing of defrost condition a predetermined time before a system valve is reversed to commence defrosting of the outside coil. By this method, at the time that the indoor coil begins to cool the supply air, the supplementary heating unit has achieved a sufficient output such that it functions to heat up the supply air, and to alleviate the short-term cold blow effect.

DETAILED DESCRIPTION OF THE PREFERRED EMBODIMENTS

Figure 1:
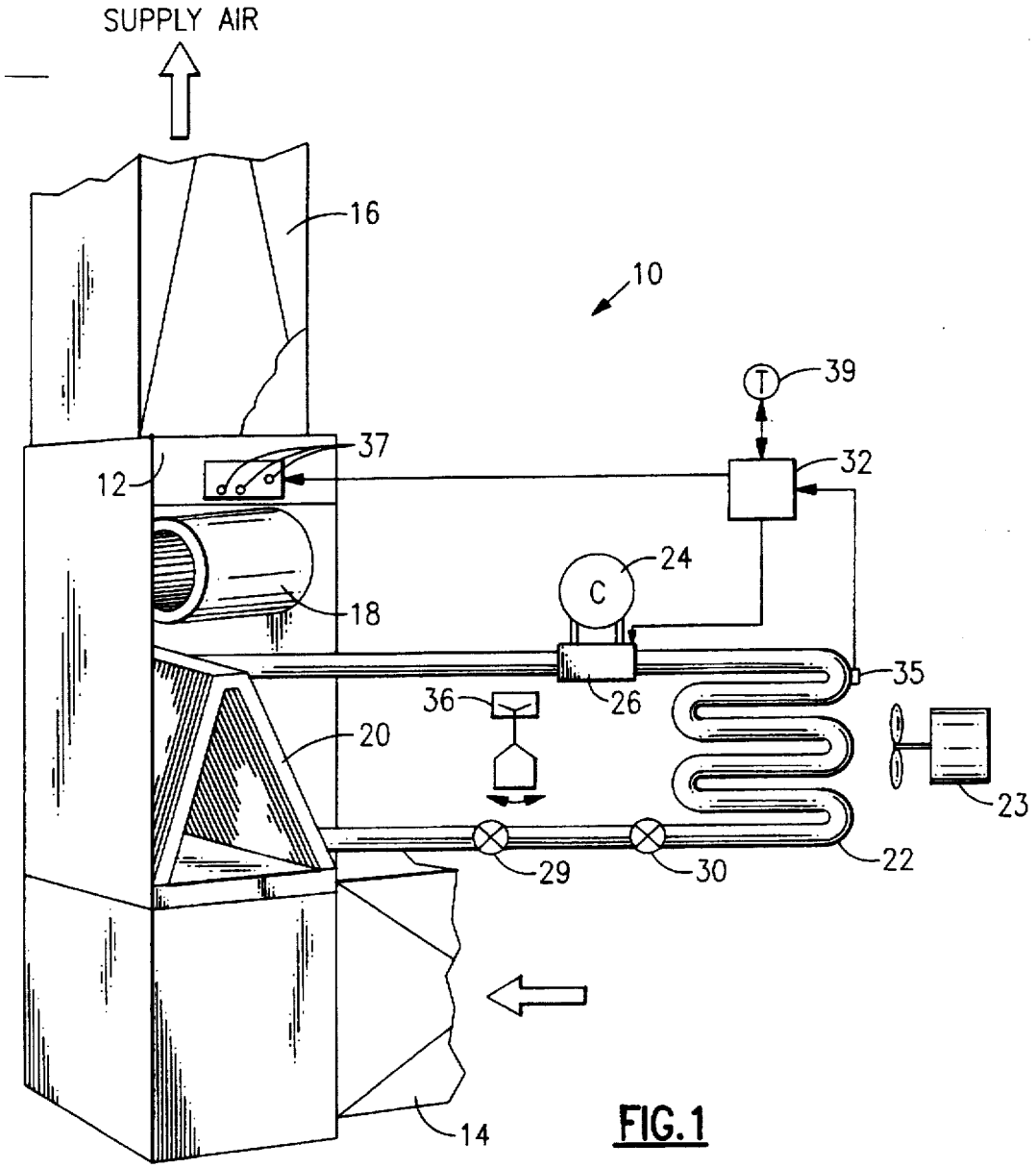
FIG. 1 is a pictorial representation of a heat pump heating system of the type in which the present invention may be implemented.
Figure 2:
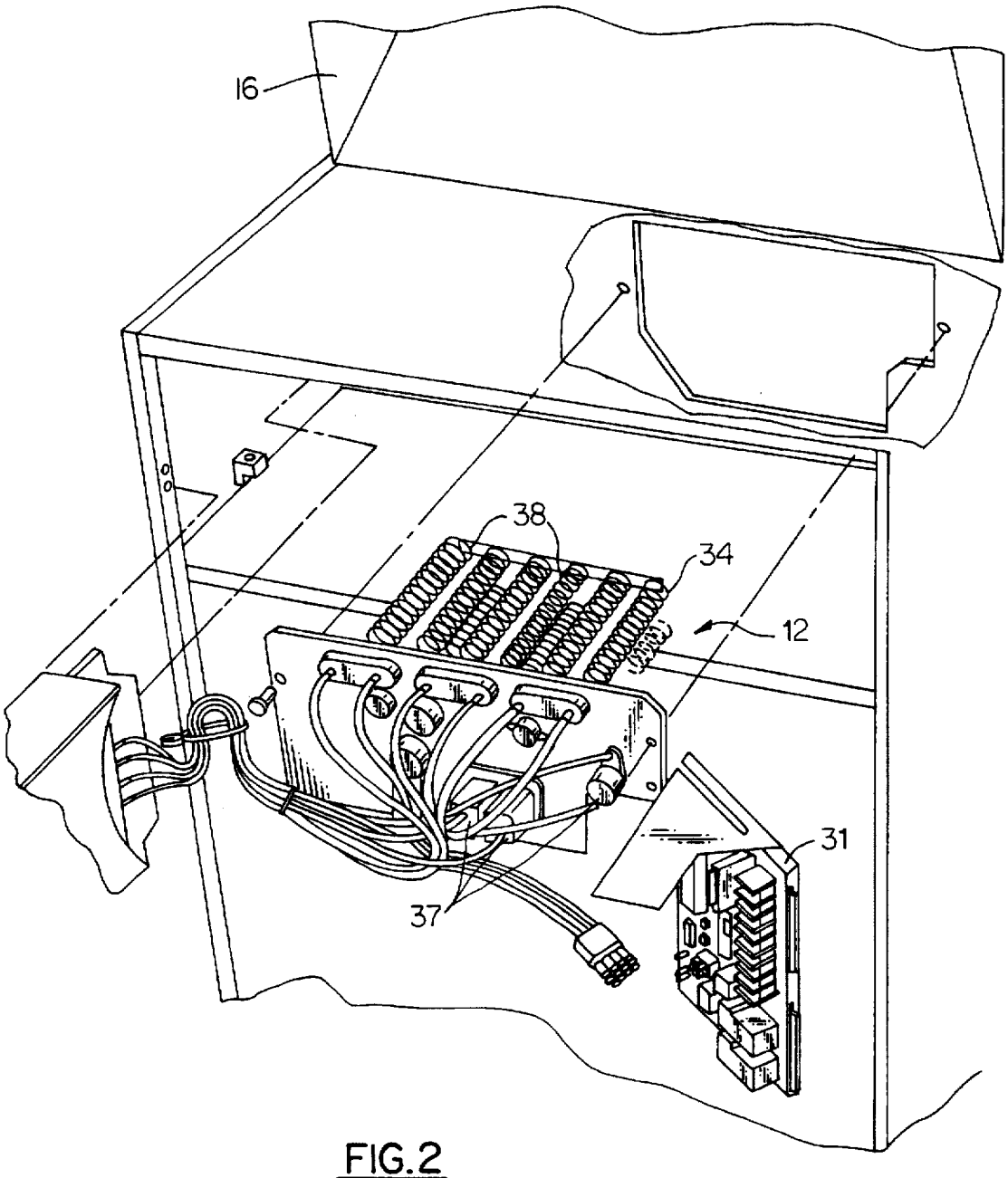
FIG. 2 is a perspective view of an illustrative supplementary heating unit which is controlled according to a method of the present invention.

A heat pump type heating system 10 having a supplementary heating unit 12 is shown in FIG. 1. Heating system 10 includes a return air plenum 14, a supply air plenum 16, and a blower motor assembly 18 for drawing air into return air plenum 14 and supplying it back to the space to be conditioned by way of supply air plenum 16.

Heating system 10 includes an indoor coil 20 and an outdoor coil 22. In heating mode, indoor coil 20 functions as a condenser to provide heat to the indoor air, while in a cooling mode, outdoor coil 22 functions as a condenser and indoor coil 20 functions as an evaporator. The system changes to a cooling mode when a defrost routine is activated.

Indoor coil 20 is connected to a standard closed loop refrigeration circuit which includes a compressor 24 a four-way system valve 26, an outdoor coil 22 a fan 28 and expansion valves 29 and 30. System valve 26 is selectively operated by a defrost control board 32 to function in the respective heating or cooling modes, with either the expansion valve 30 functioning to meter the flow to the indoor coil 20 or the expansion valve 29 functioning to meter the refrigerant flow to outdoor coil 22. Defrost control board 32, which may comprise a microprocessor-based control system, can also be applied to selectively operate compressor 24 and outdoor fan 28. The mode of the system is changed from a heating mode to a cooling mode in part by reversing 4-way system valve 26.

Heating system 10 further includes a supplementary heating unit 12. Supplementary heating unit 12 is shown in FIGS. 1 as being provided by an electric resistance type heating unit, otherwise known as an electric strip heater. Strip heater 12 includes a plurality of electric resistance heating elements 34. Electric resistance heaters are commonly controlled using sequencers 37. Sequencers 37 are "snap-disk" type heat activated relays. Typically each sequencer controls one or two electric resistance heating elements. Sequencers 37 are activated by supplying a control voltage to a small internal (to the sequencer) electric resistance heater. The heater will heat the internal snap disk hot enough to cause a rapid deformation. This deformation is mechanically connected to a set of contacts which energizes the electric resistance heater element. When the supplementary heaters are to be de-energized, the control voltage to the sequencer is de-energized. After a short period of time, the snap disk cools and rapidly returns (snaps back) to its original form, breaking the electrical contacts to resistance heaters 34.

Sequencers are widely used in electric resistance heater applications due to their high reliability. The "snap-action" prevents excessive arching of the contacts making them considerably more reliable and cheaper than electro-inductive relays. The heating period of the snap-disk causes the delay in energizing the electrical resistance heating elements. This leads to the short-term "cold blow" of heat pumps when in defrost mode. Supplementary heat may also be provided by, for example, a fossil fuel furnace or any other type of conventional heat source.

Whatever the type of supplementary heating unit implemented, there will be a warm up delay between the time the supplementary heating unit is activated, and the time the supplementary heating unit achieves an output above a level sufficient to offset the cold blow effect. In an electric strip type heating unit, this delay is a result of the sequencer delay, as described above. In a fossil fuel type furnace, a warm up delay results from a combustion blower start-up delay in combination with a heat exchanger heat-up delay.

Ice and frost will build up on outdoor coil 22 when heating system 10 operates close to or below 40°–45° F. outdoor ambient. When the presence of ice and frost is sensed on the outdoor coil, or when certain predetermined conditions indicate a likelihood of ice and frost buildup, then a routine is initiated to defrost outdoor coil 22. Defrosting the outdoor coil requires reversing system valve 26 to change the mode of the system from a heating mode to a cooling mode and de-energize outdoor fan 28. The presence of ice and/or frost on outdoor coil may be sensed in a variety of different ways. For example a thermostatic switch or thermocouple, both indicated by 35 on the outdoor coil 22 can detect the presence of ice and/or frost on coil 22 by detecting the temperature of coil 22. Alternatively, sail switch 36 can be provided to detect loss of airflow through the outdoor coil 22 (from outdoor fan 28) due to ice accumulation. Pressure switches could also be used. Timers are often combined with one or more of the above control methods to initiate defrost.

When the position of system valve 26 is reversed to change the mode of operation, then indoor coil 20 functions as an evaporator and works to cool the air that is blown across it. This effect is known as "cold blow." Supplementary heating unit 12 is provided to ameliorate this cold blow effect. However, in the prior art, a short term cold blow effect is encountered as a result of a warm up delay as described above despite the providing of a supplementary heating unit. Prior art defrost control methods fail to alleviate a short-term cold blow effect because the indoor coil in the prior art systems begins cooling air that is blown across it before the provided supplementary heating unit heats up to an output level sufficient to offset the cooling effect of indoor coil 20.

Figure 3:
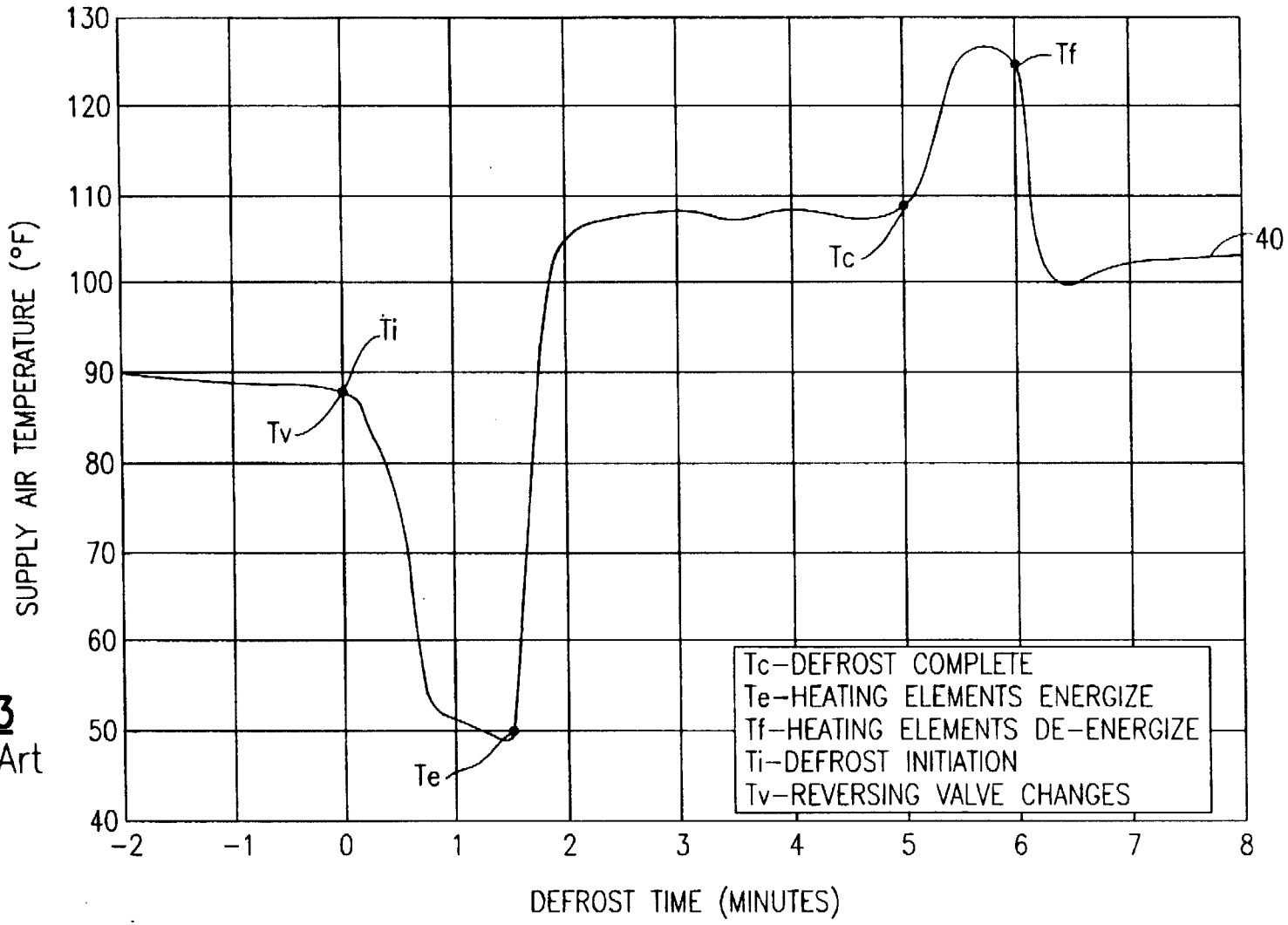
FIG.3 Prior Art
FIG. 3 is a graphical illustration of the supply air, temperatures during defrost as a function of time for a typical prior art heat pump heating system.

FIG. 3 shows a plot 40 of the supply air during defrost as a function of time for a typical prior art heat pump heating system. When a call for defrost is made according to the prior art method, supplementary heating unit 12 is activated, and concurrently (that is, immediately thereafter or immediately prior thereto), all components of heat pump heating system 10 are changed to defrost mode. Defrost mode consists of changing the reversing value to the cooling position and de-energizing the outdoor fan while the indoor fan and compressor continue to operate.

Referring to FIG. 3, the result of activating supplementary heating unit 12, reversing system valve 26, and de-energizing outdoor fan 28 concurrently will be described. It is seen that when defrost is initiated at time $T_i$, that the temperature of supply air falls rather rapidly, from a temperature of about 89° F. at a time of $T_i$, to a temperature of about 51° F. about 1 min after $T_i$. Supply air temperature does not rise above 80° F. until more than two minutes after $T_i$. This is a short-term cold blow condition.

When the present invention is implemented, reversing of system valve 26 is delayed for a predetermined time after a defrost initiation time, at which time supplementary heating unit 12 is activated and components of heating system other than system valve 26 are configured for defrost mode. In response to the sensing of a defrost condition, supplementary heating unit 12 is activated. A predetermined time thereafter, system valve 26 is reversed for commencing defrosting of outdoor coil 22. The predetermined delay time after which system valve 26 is reversed is selected so that supplementary heating unit 12 has achieved a sufficiently high output when system valve 26 is activated and outdoor fan 28 is de-activated. Supplementary heating unit 12 has achieved a sufficiently high output when it offsets the cooling effect of cold indoor coil operating in defrost (cooling) mode. Supplementary heating unit 12 is considered to have offset the cooling effect of cold indoor coil 20 if the supply air temperature 40 and 50, after reversing of system valve 20, is not more than about 5° F. less than it was before defrost initiation.

At the time system valve 26 is reversed, outdoor fan 28 is de-energized. Outdoor fan 28 may also be de-energized at the time supplementary heating unit 12 is activated. However, it is preferred for energy efficiency purposes to de-energize outdoor fan 28 when system valve 26 is reversed.

Figure 4:
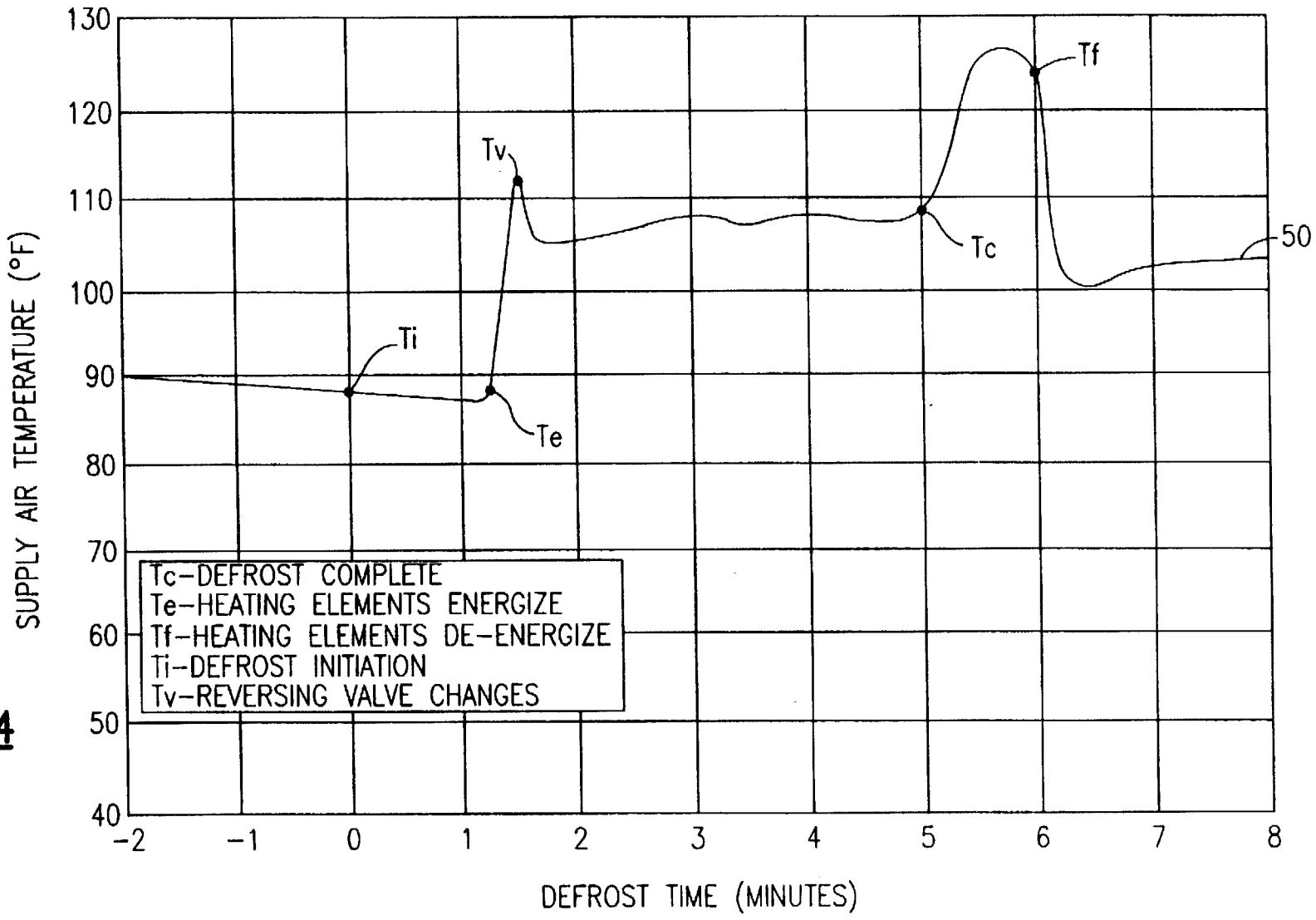
FIG. 4 is a graphical illustration of the supply air, temperatures during defrost as a function of time for a heat pump heating system controlled according to a method of the invention.

FIG. 4 is a graphical illustration of the supply air 50, during defrost as a function of time for a heat pump heating system controlled according to the method of the invention.

Defrost is initiated at time $T_i$. At time $T_i$, supplementary heater 12 is activated with or without various heating system components including de-energizing outdoor fan 28 are configured for defrost mode operation except for system valve 26. At time $T_v$, a predetermined time after $T_i$, system valve 26 is reversed to commence defrosting of outdoor coil 22. In the example of FIG. 4, wherein the heat pump heating system is a Carrier 38YRA036 type heating system, and supplementary heating unit 12 is a Carrier model FK4BNF003020 AAAA type heating unit, then delay time, $T_d=T_v-T_i$, is selected to be about 90 seconds.

A timer 39 for controlling the delay time, $T_d=T_v-T_i$, can be provided in communication with control board 32. Timer 39 can be made stepwise adjustable, or adjustable between an infinite amount of intermediate positions between a maximum and a minimum time. For example, timer 39 can be made adjustable between 0 and 5 minutes. Timer 39 can be an external timer or can be implemented by programming of an internal microprocessor timer of control board 32. Providing adjustable timer 39 allows the delay time, $T_d=T_v-T_i$, to be optimized for the requirements of the particular heating system in which the present invention is implemented.

When a defrost condition ceases, system valve 26 is reversed and outdoor fan 12 is re-energized in order to return heat pump heating system 10 to a heating mode of operation. A defrost condition ceases when substantially all ice and/or frost is removed from outdoor coil. The cessation of a defrost condition can be sensed, for example, by thermostatic switch 35, a thermocouple, by sail switch 36, or by pressure switches. Timers can be combined with one or more of the above control methods to detect the cessation of a defrost condition.

While the present invention has been explained with reference to a number of specific embodiments, it will be understood that the spirit and scope of the present invention should be determined with reference to the appended claims.

What is claimed is:

1. A method for operating a heat pump heating system, said heating system having a compressor, a system valve, an outdoor coil and fan, an indoor coil, and a supplementary heating unit, said method comprising the steps of:

determining if a said outdoor coil requires defrosting;

upon a determination that said outdoor coil requires defrosting energizing said supplementary heating unit;

awaiting a predetermined delay time; and reversing said system valve and turning on said compressor and said indoor fan to effect defrosting of said outdoor coil while allowing said supplementary heating unit to continue to be energized.

2. The method of claim 1, wherein said heating system further includes an outdoor fan, said method further including the step of de-energizing said outdoor fan when said system valve is reversed.

3. The method of claim 1, wherein said heating system further includes an outdoor fan, said method further including the step of de-energizing said outdoor fan when said supplementary heating unit is energized.

4. The method of claim 1, wherein said predetermined delay time depends on the time required for said supplementary heating unit to achieve an output sufficient to offset a cooling effect of a cold indoor coil.

5. The method of claim 1, wherein said determining step includes the step of sensing the temperature of said outdoor coil.

6. The method of claim 1, wherein said determining step includes the step of sensing the temperature of said outdoor coil using a thermocouple.

7. The method of claim 1, wherein said determining step includes the step of sensing the temperature of said outdoor coil using a thermostatic switch.

8. The method of claim 1, wherein said determining step includes the step of detecting a loss of airflow through said outdoor coil.

9. The method of claim 1, wherein said determining step includes the step of detecting a loss of airflow through said outdoor coil using a sail switch.

10. The method of claim 1, wherein said delay time is selected to be about 90 seconds.

11. The method of claim 1, further comprising the setup of setting a timer according to a predetermined delay time.

12. The method of claim 1, wherein said heating system includes an adjustable timer for controlling operation of said system valve, said method further comprising the step of adjusting said timer to a time corresponding to said predetermined delay time.

13. The method of claim 1, wherein said supplementary heating unit is provided by a system of electrical resistance type heating elements, and wherein said energizing step includes the step of energizing said system of electrical resistance type heating elements.

14. The method of claim 1, wherein said supplementary heating unit is provided by a fossil fuel type heat source, and wherein said energizing step includes the step of energizing said fossil fuel type heat source.

* * * * *